US010947783B2

(12) United States Patent
Stevens, Jr.

(10) Patent No.: US 10,947,783 B2
(45) Date of Patent: Mar. 16, 2021

(54) LADDER STABILIZATION SYSTEM

(71) Applicant: Olive Tree Inspirations LLC, Grayson, GA (US)

(72) Inventor: Paul H. Stevens, Jr., Grayson, GA (US)

(73) Assignee: Olive Tree Inspirations, LLC, Garyson, GA (US)

( * ) Notice: Subject to any disclaimer, the term of this patent is extended or adjusted under 35 U.S.C. 154(b) by 259 days.

(21) Appl. No.: 16/058,054

(22) Filed: Aug. 8, 2018

(65) Prior Publication Data

US 2020/0048963 A1 Feb. 13, 2020

(51) Int. Cl.
*E06C 7/46* (2006.01)

(52) U.S. Cl.
CPC ..... *E06C 7/46* (2013.01)

(58) Field of Classification Search
CPC ... E06C 7/188; E06C 7/42; E06C 7/44; E06C 7/46; E04G 5/02; E04G 5/025
See application file for complete search history.

(56) References Cited

U.S. PATENT DOCUMENTS 47,910 A * 5/1865 Sheilds ..... E04H 12/2215 52/165
427,815 A * 5/1890 Wolf ..... E04H 12/2215 52/165
870,752 A * 11/1907 White ..... D06F 53/04 248/353
1,193,043 A * 8/1916 Merrin ..... E06C 7/46 182/111
1,450,694 A * 4/1923 Mahoney ..... E06C 7/42 182/107
1,536,434 A * 5/1925 Hearn ..... E06C 7/46 182/111
1,897,840 A * 2/1933 Greene ..... E06C 7/46 182/111
2,371,460 A * 3/1945 Needham ..... E06C 7/44 182/204
2,868,427 A * 1/1959 Hess ..... E06C 7/42 182/107
3,456,757 A * 7/1969 Sain ..... E06C 7/46 182/111

(Continued)

OTHER PUBLICATIONS

Notice of Allowance dated Aug. 30, 2019, from corresponding design U.S. Appl. No. 29/659,318.

(Continued)

*Primary Examiner* — Colleen M Chavchavadze
*Assistant Examiner* — Shiref M Mekhaeil
(74) *Attorney, Agent, or Firm* — Womble Bond Dickinson (US) LLP

(57) ABSTRACT

A ladder stabilization system for holding a ladder in place on a support surface that can include a pair of opposed ladder stabilizer devices that are configured to be operatively placed in opposition to receive a bottom portion of the pair of spaced legs of the ladder to positionally fix the ladder relative to the vertical structure. The ladder stabilization system acts to secure and stabilize the bottom portion of the ladder to prevent the base of the ladder from sliding, skidding, or otherwise moving while a user is on the ladder. The present invention improves user safety and reduces the need for having a second individual support the base of the ladder.

21 Claims, 8 Drawing Sheets

(56) References Cited

U.S. PATENT DOCUMENTS 3,618,703 A * 11/1971 Wilke ..... E06C 7/42 182/107
3,724,145 A * 4/1973 Daniel ..... E02D 5/801 52/157
4,039,047 A 8/1977 Larson et al.
4,153,137 A * 5/1979 Johnson ..... E06C 7/42 114/362
4,156,332 A * 5/1979 Thompson ..... E04H 12/2215 52/165
4,576,250 A * 3/1986 Marish ..... E06C 7/46 182/108
4,607,726 A * 8/1986 Davis ..... E06C 7/44 182/204
4,644,713 A * 2/1987 Lehman ..... E04H 12/2215 52/165
4,669,576 A * 6/1987 Jones ..... E06C 7/46 182/108
4,694,932 A 9/1987 Schmitt
4,846,305 A * 7/1989 Kupfert ..... E06C 7/42 182/97
5,078,231 A * 1/1992 Davis ..... E06C 7/42 182/107
5,339,921 A * 8/1994 Faupel ..... E04D 15/00 182/111
5,361,868 A 11/1994 Bartos
5,558,306 A * 9/1996 Binford ..... B44D 3/14 248/148
5,669,462 A * 9/1997 Jennings ..... E06C 7/44 182/111
5,865,268 A * 2/1999 Finneran ..... E06C 7/46 182/107
D474,284 S * 5/2003 Spencer ..... D25/68
8,418,809 B2 4/2013 Donlon
D701,618 S 3/2014 Donlon
8,684,138 B1 * 4/2014 Marsh, II ..... E06C 7/188 182/116
8,807,277 B1 * 8/2014 Reyna Lerma ..... E06C 7/42 182/111
D733,325 S * 6/2015 Robinson, Jr. ..... D25/68
9,810,023 B2 * 11/2017 Stewart ..... E06C 7/426
10,089,906 B2 * 10/2018 Warnes ..... G09F 7/18
10,208,497 B1 * 2/2019 Warnes ..... E04H 12/2215
D871,614 S * 12/2019 Stevens, Jr. ..... D25/68
2006/0124393 A1 * 6/2006 Robinson ..... E06C 7/46 182/107
2008/0223657 A1 * 9/2008 Keefe ..... E06C 7/46 182/108
2010/0051384 A1 * 3/2010 Currie ..... E06C 7/46 182/107
2011/0100752 A1 * 5/2011 Donlon ..... E06C 7/46 182/107
2011/0132684 A1 * 6/2011 Wilkins ..... E06C 7/46 182/107
2012/0199416 A1 * 8/2012 Hopkins ..... E06C 7/42 182/111
2013/0119213 A1 * 5/2013 Watson ..... E06C 7/42 248/201
2014/0318894 A1 * 10/2014 Chow ..... E06C 7/48 182/214
2016/0348436 A1 * 12/2016 Reyes ..... E06C 7/188
2019/0203534 A1 * 7/2019 Bowling ..... E06C 7/188
2020/0087984 A1 * 3/2020 Wells ..... E04H 15/42
2020/0087985 A1 * 3/2020 Polzen ..... E06C 7/423

OTHER PUBLICATIONS

Ex Parte Quayle Action dated Aug. 8, 2019, from corresponding design U.S. Appl. No. 29/659,318.

* cited by examiner

LADDER STABILIZATION SYSTEM

FIELD OF THE INVENTION

The present disclosure generally relates to ladder safety devices, more particularly, the present disclosure relates to a ladder stabilization system used for holding a ladder, such as a conventional extension ladder or straight ladder, in a stable condition on the support surface adjacent to a fixed structure. The present disclosure acts to resist both sliding and pivoting movements of the ladder and maintains the base of the ladder in a preset position relative to the fixed structure.

BACKGROUND

Ladder stabilizing devices or systems are known in the art and are conventionally used to space a ladder from the wall of a structure and stabilize the attached ladder as it rests relative to the wall. The primary use of such ladder stabilizing devices or systems is to permit the generation of stabilized work space away from the wall for a person climbing the ladder, as is often necessary when painting a wall, cleaning the gutters of a building, or using the ladder to climb on to a roof.

Free standing ladders are often configured for leaning against a fixed structure, such as an exterior wall of a building. The angle relative to the fixed structure at which a ladder is conventionally erected is typically determined by limitations of available space or by the workman's need to stand near the top of the ladder rather than any considerations of stability or safety.

Each year a number of individuals are injured in falls from a ladder that are caused by the ladder failing to remain stationary as the person climbs toward the top thereof. Serious injury can occur is such falling accidents, not only from striking the ground, but from being struck by tools or materials as they fall from the ladder. Regardless of the configuration, the stability of a ladder is an important safety consideration. Thus, it is recommended that in addition to the worker on the ladder, an additional worker be located at the base of the ladder in order to stabilize the ladder. Unfortunately, many workers operate independently and oftentimes scale and work atop ladders without having another worker support the ladder from below. The present disclosure eliminates the need for an additional worker at the base of the ladder by providing a ladder stabilization system that can be quickly and easily positioned relative to a base portion of the ladder to be used. The ladder stabilization system effectively stabilizes the ladder during use by preventing twisting, pivoting, and shifting or sliding of the base of the ladder relative to the fixed structure.

Ladders are used for many purposes on a wide variety of work surfaces, and any stabilizing means that is adequate for one set of conditions can often be unsuited for others. As an example, spikes driven into the ground at the base of the ladder are useful when working outdoors but would do considerable damage if used on a hardwood floor or deck surface. Some examples of innovative devices for securing the lower end of an upright, inclined ladder are shown in the following patents.

Larson et al., in U.S. Pat. No. 4,038,047, shows a ladder pivot foot with ground spikes. Larger wedges that clip to the foot of a ladder are disclosed by Marish in U.S. Pat. No. 4,576,250, and by Jones et al. in U.S. Pat. No. 4,669,255. Fitzpatrick, in U.S. Pat. No. 5,499,691, describes an emergency breaking system using large spikes that attach to the rungs of a ladder, while in U.S. Pat. No. 5,669,462 Jennings discloses a ladder leveling apparatus with multiple spikes to hold the ladder against slippage. Similarly, Sloop, in U.S. Pat. No. 5,890,560, describes a ladder stabilization device that attaches a rung of the ladder to the fixed structure upon which the ladder is leaning and Hankins, in U.S. Pat. No. 6,089,350, shows a ladder safety anchor device is disclosed having a U-shaped wedge surface penetrating member that can limit the surfaces on which such a device can be used. Similarly, both U.S. Pat. No. 6,955,243 to Huff and U.S. Pat. No. 7,743,886 to Feemster et al. comprise a pair of spike members that would limit and restrict the application of their respective devices to only more compliant support surfaces and terrains.

It would be desired to provide a simple, easy to use ladder stabilization system that is adaptable to different terrains, surfaces, and working conditions.

It would be desired to design such a ladder stabilization system to be easily and inexpensively selectively coupled to any standard ladder without requiring special tools or skills.

It would be desired to provide a lightweight and non-cumbersome ladder stabilization system that can be easily moved about a job site. It would also be desired to have a ladder support attachment that utilizes the load placed on the ladder support attachment by the ladder to hold the ladder at the desired position relative to the vertical structure.

Further, it would be desired to provide a ladder stabilization system that can easily and quickly selectively coupled to a conventional ladder without the user voiding the warranty of the ladder as is common with prior art devices requiring structural alterations to the ladder for device attachment and use.

Accordingly, there is a need in the art for an ladder stabilization system, which can be coupled to a portion of a ladder that can aid on operatively positioning a ladder at a desired acute angle relative to the substantially vertical wall of the fixed structure to enhance the stability of the ladder and the safety of personnel using the anchored ladder.

SUMMARY

Described herein is a ladder stabilization system and a method of using a ladder stabilization system. In one aspect, the present invention provides a ladder stabilization system having an efficient simple design that permits a user too quickly and easily position the ladder stabilization system to a desired portion of a ground surface to allow the legs of a ladder to be fixed relative to a substantially vertical support wall structure. In one aspect, the ladder stabilization system is configured to utilize the load placed on the ladder stabilization system by a ladder that is selectively and securably positioned therein the ladder stabilization system to positionally fix the legs of the ladder relative to the support surface. In a further aspect, the ladder stabilization system allows for positioning on a level or graded support surface of varying soil density as well as on conventional deck surfaces having deck boards running either perpendicular or parallel to the support wall structure.

In one aspect, described herein is a ladder stabilization system for holding a ladder in place on a support surface. In this aspect, the ladder stabilization system can have a pair of opposed ladder stabilizer devices. Each ladder stabilizer device can have an elongated planer base member; an elongated planer stabilizer member; a first elongated planer side member; and a second elongated planer side member. In this aspect, the elongated planer stabilizer member is connected to a base edge of the base member and has an upper portion that extends perpendicularly upwardly away from a top surface of the base member and a lower portion extending downwardly perpendicularly away from a bottom surface of the base member. Further, the first elongated planer side member extends perpendicular relative to the base member and is connected to a first side edge of the base member and a first edge of the upper portion of the stabilizer member. The second side member extends perpendicular relative to the base member and is connected to a portion of the second side edge of the base member and a second edge of the upper portion of the stabilizer member.

In one aspect, the second side member has an elongate length that is less than the elongate length of the first side member and the elongate length of the base member. In this aspect, the base member, the first side member, and the second side member of each ladder stabilizer device defines a partially open trough that is configured to receive a bottom end of one leg of the ladder. In operation, portions of the respective partially open trough members of the pair of opposed ladder stabilizer devices are positioned in opposition and are configured to receive a bottom portion of the pair of spaced legs of a ladder to and a plurality of spaced transversely mounted rungs to positionally fix the ladder relative to the vertical structure.

In optional aspects, it is contemplated that each ladder stabilizer device can be formed as a unitary, monolithic member.

Various implementations described in the present disclosure can include additional systems, methods, features, and advantages, which can not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

DESCRIPTION OF THE FIGURES

The features and components of the following figures are illustrated to emphasize the general principles of the present disclosure. Corresponding features and components throughout the figures can be designated by matching reference characters for the sake of consistency and clarity.

DETAILED DESCRIPTION

Figure 1:
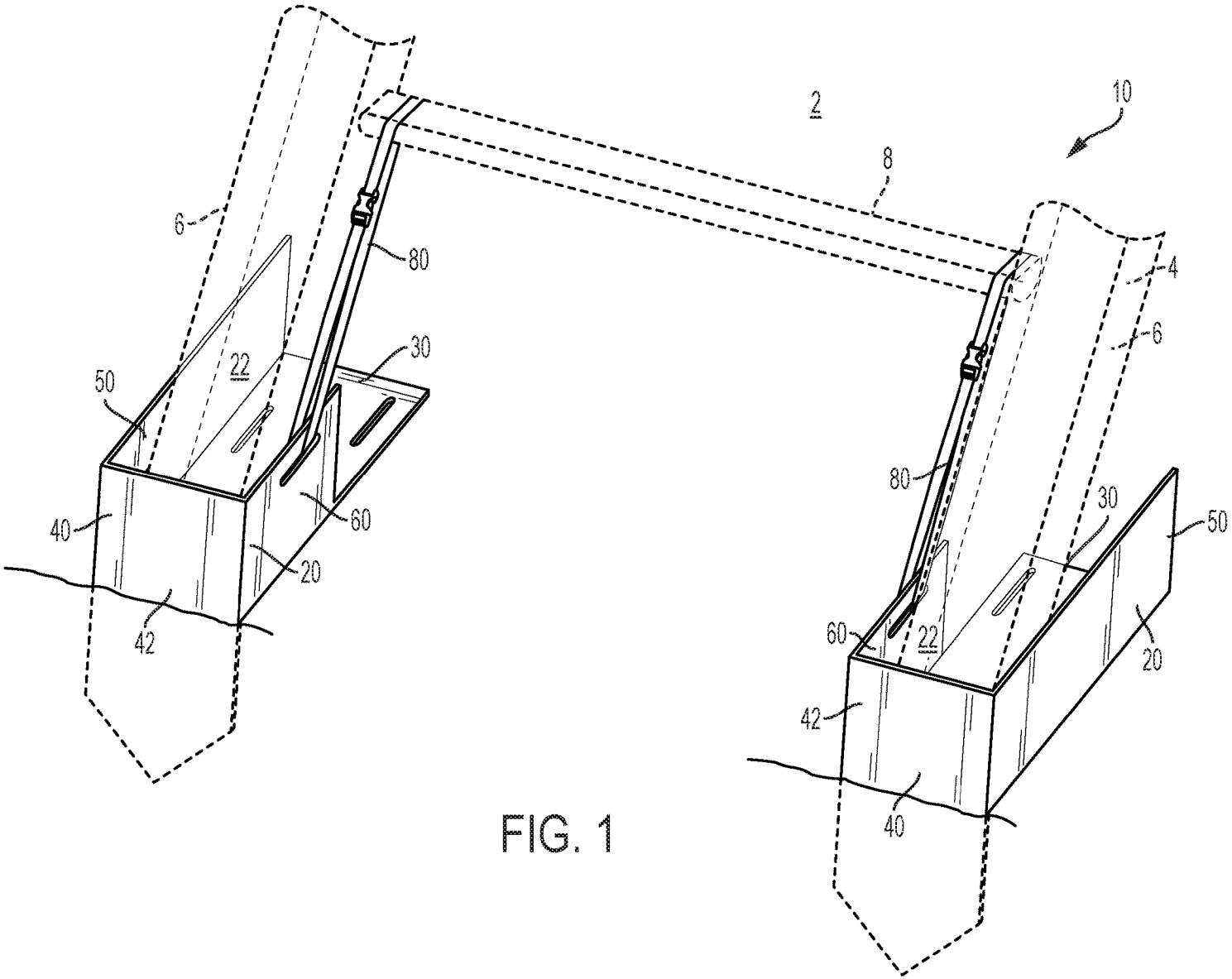
FIG. 1 is a perspective view of one embodiment of a ladder stabilization system, showing a pair of bottom legs of an inclined ladder positioned therein opposed ladder support devices that are selectively positionally fixed in the ground relative to a fixed structure, and showing a pair of anchor lines, each anchor line selectively securing the relative position between the bottom ends of the inclined ladder and the respective ladder support device.
Figure 2:
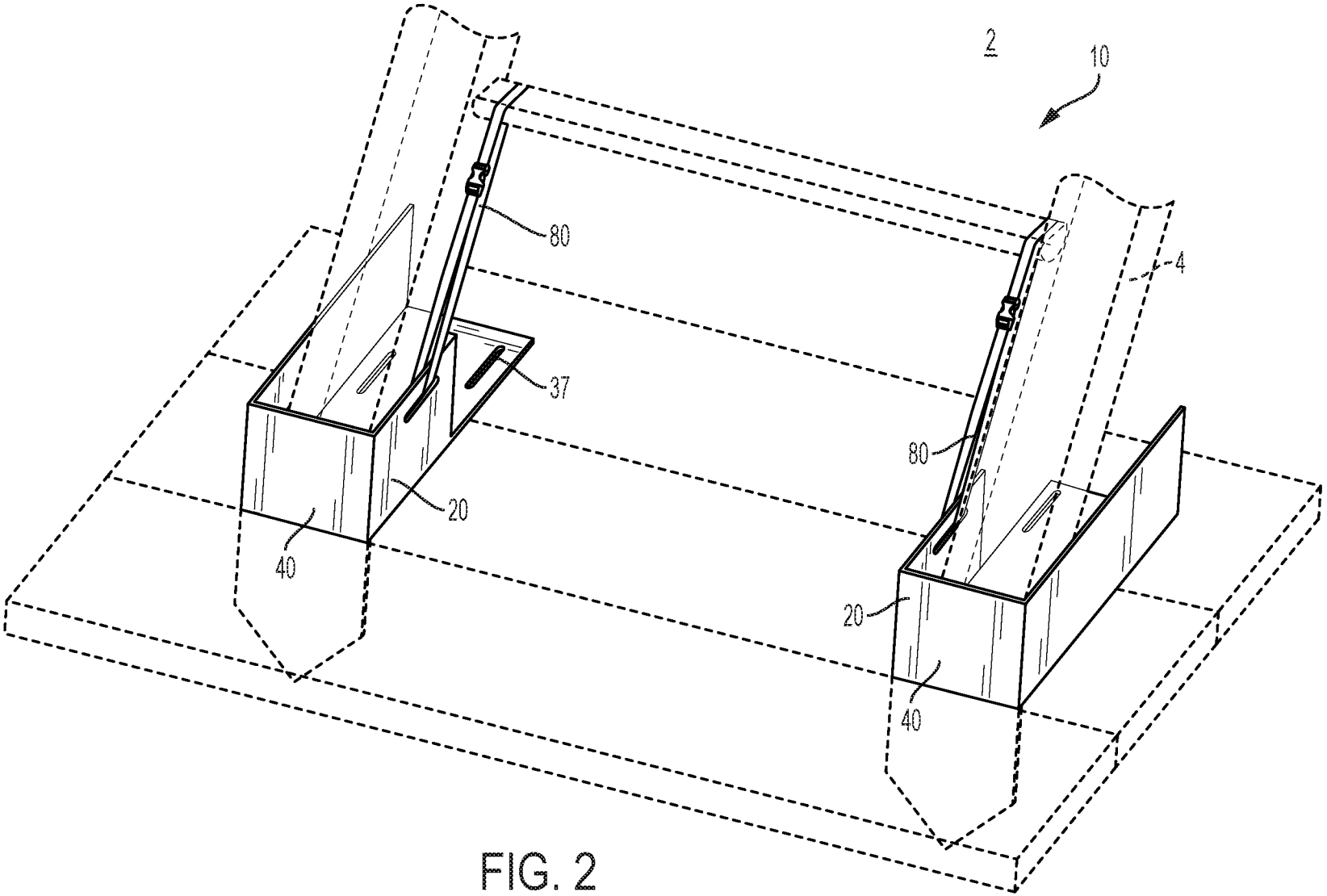
FIG. 2 is a perspective view of one embodiment of a ladder stabilization system, showing a pair of bottom legs of an inclined ladder positioned therein opposed ladder support devices that are selectively and positionally mounted on a deck having deck board running substantially parallel to a wall of the fixed structure, and showing a pair of anchor lines, each anchor line selectively securing the relative position between the bottom ends of the inclined ladder and the respective ladder support device.
Figure 3:
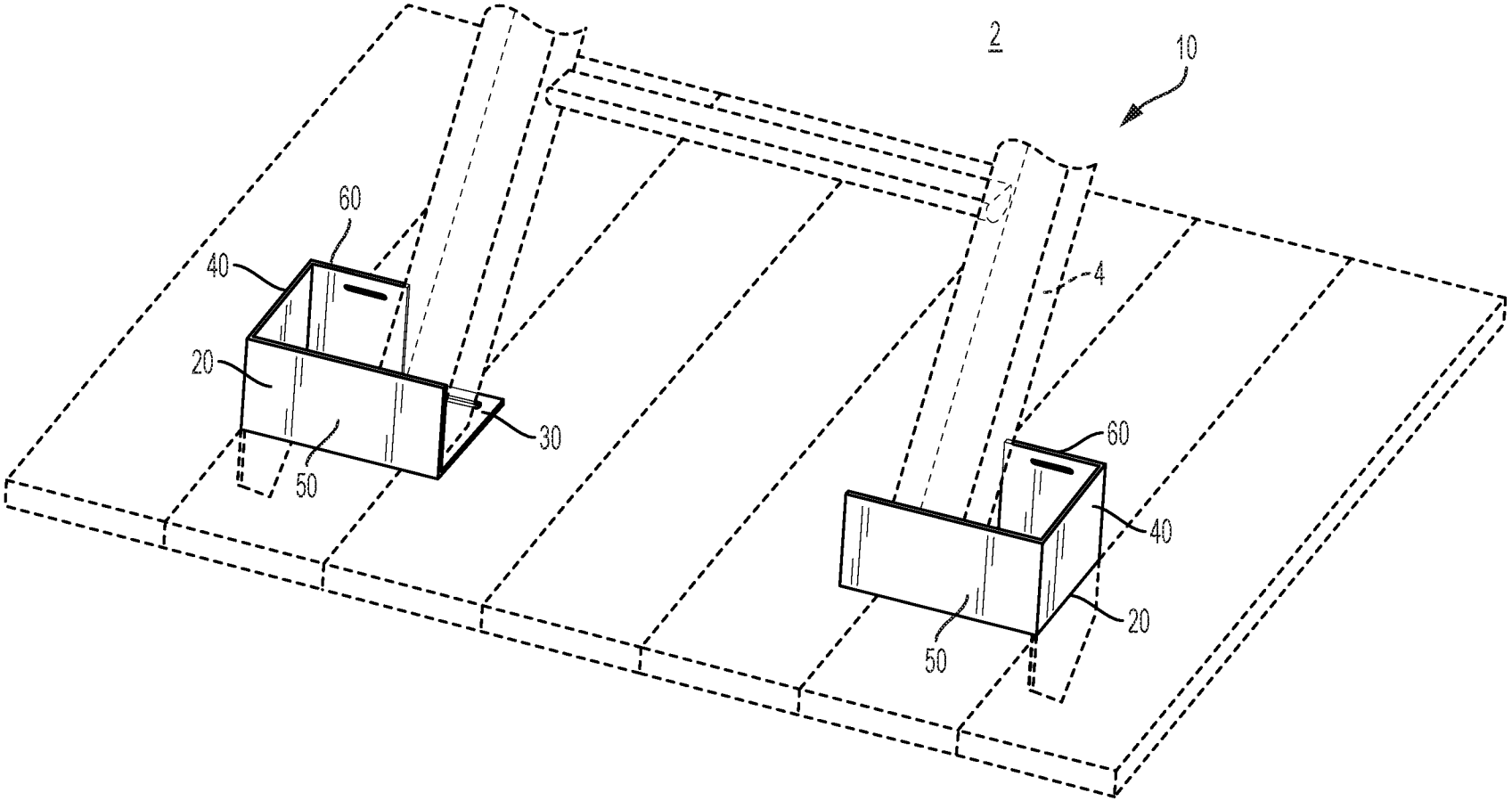
FIG. 3 is a perspective view of one embodiment of a ladder stabilization system, showing a pair of bottom legs of an inclined ladder positioned therein opposed ladder support devices that are selectively and positionally mounted on a deck having deck board running substantially perpendicular to a wall relative to a fixed structure.
Figure 4:
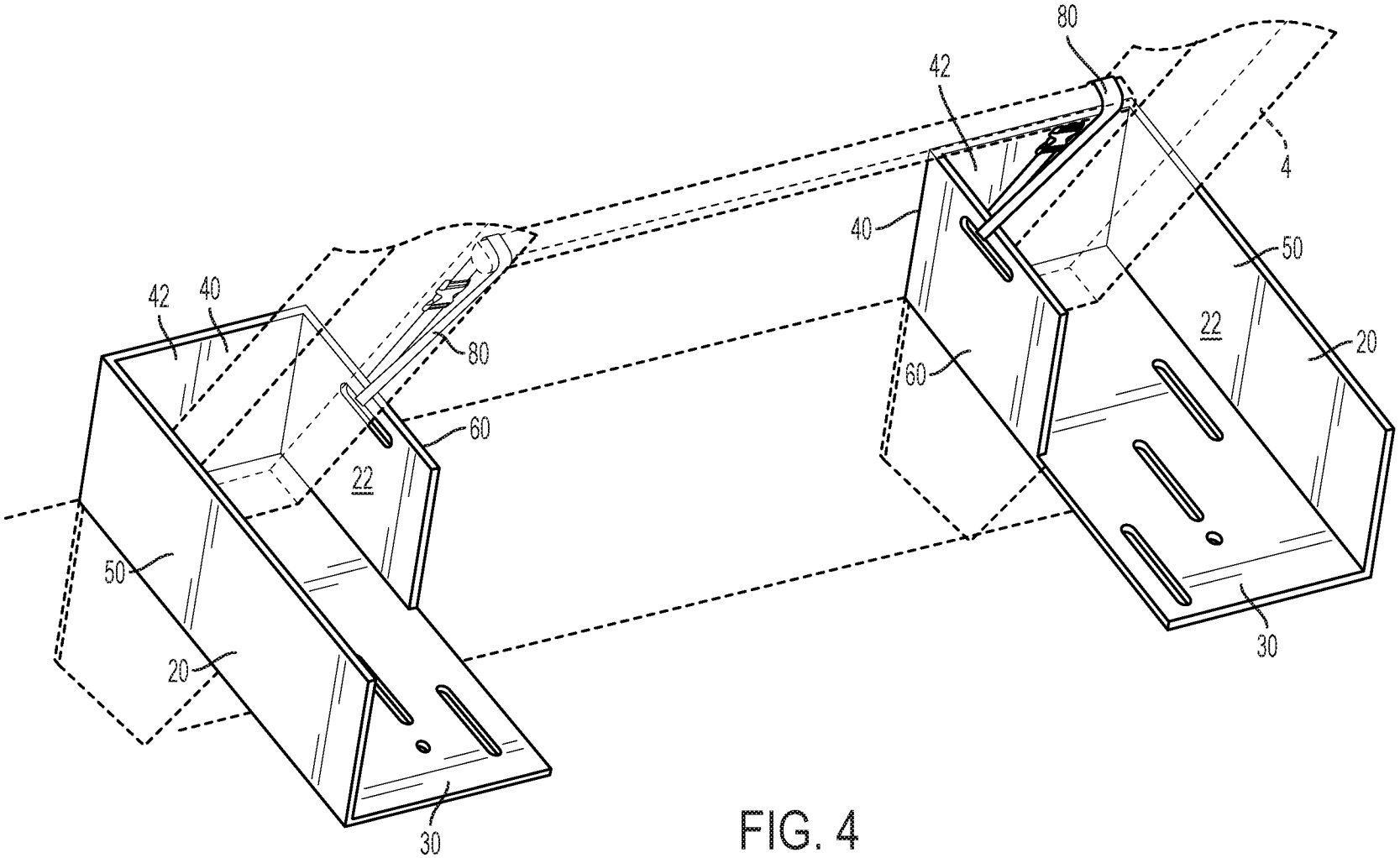
FIG. 4 is a perspective view of one embodiment of the ladder stabilization system showing a pair of opposed ladder support devices, and showing a pair of anchor lines, each anchor line selectively securing the relative position between the bottom ends of the inclined ladder and the respective ladder support device.
Figure 5:
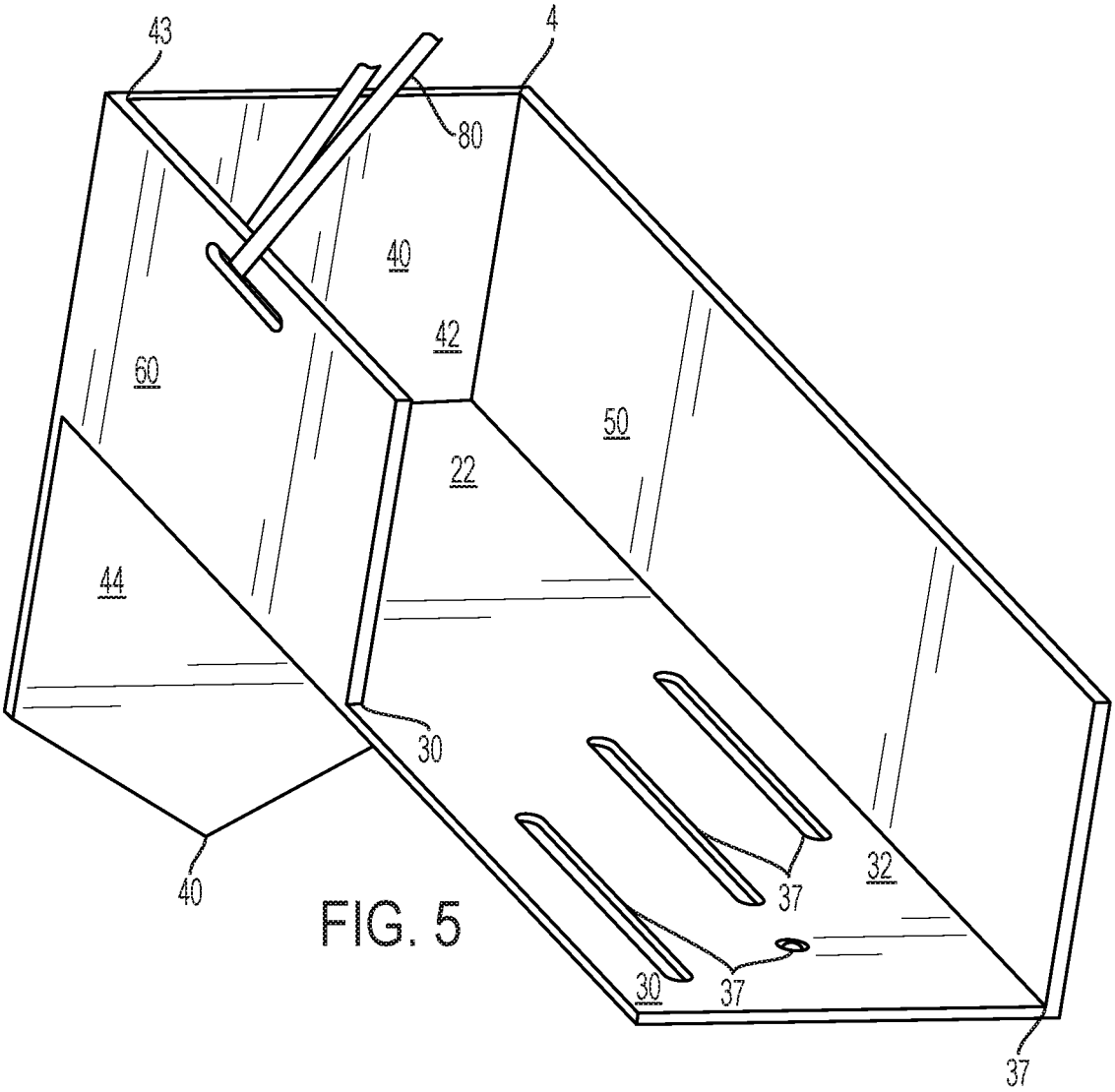
FIG. 5 is a perspective view of one embodiment of a ladder support device of the ladder support system, and showing a portion of an anchor line attached to the ladder support device.
Figure 6:
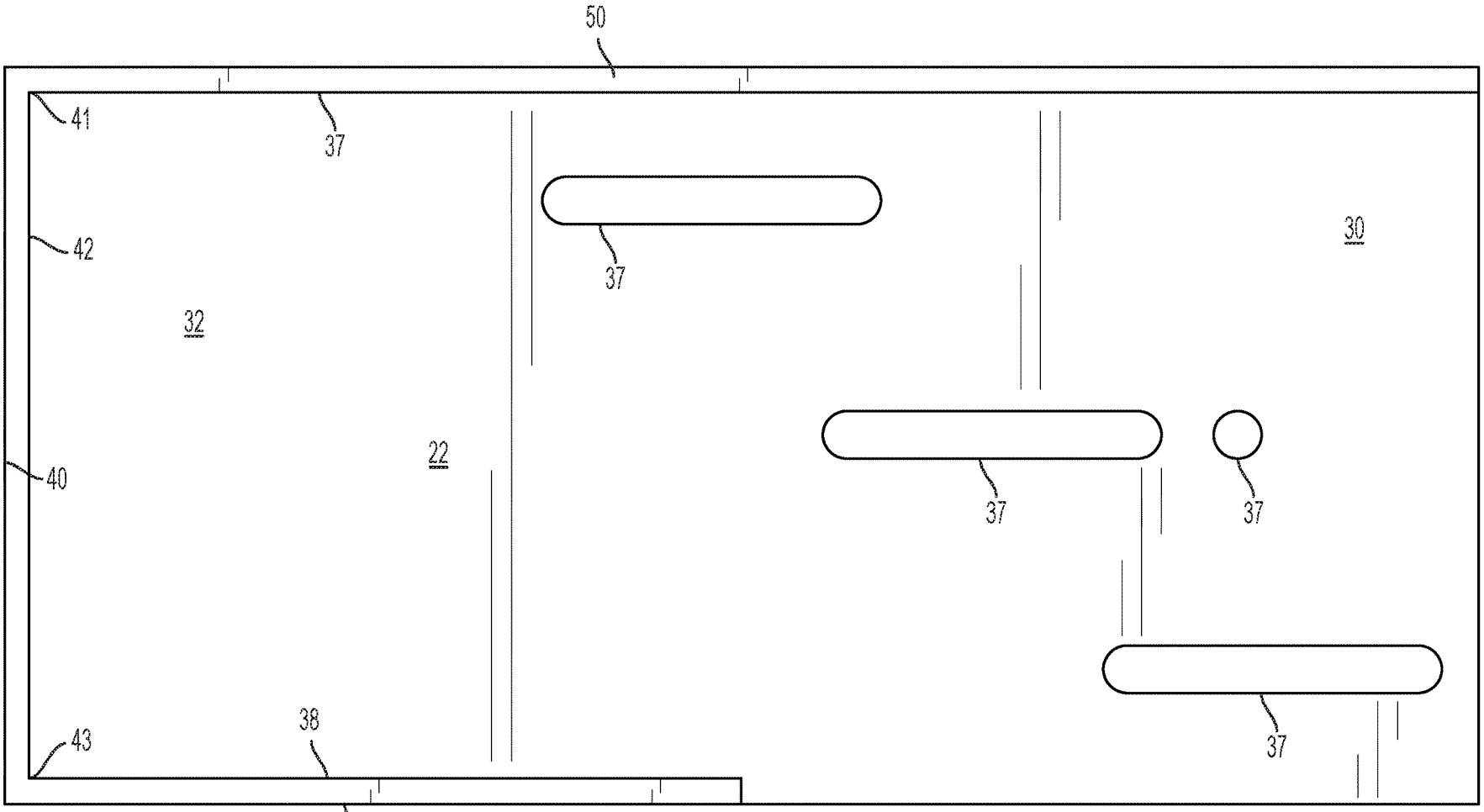
FIG. 6 is a top elevational view of one embodiment of the ladder support device of FIG. 5.
Figure 7:
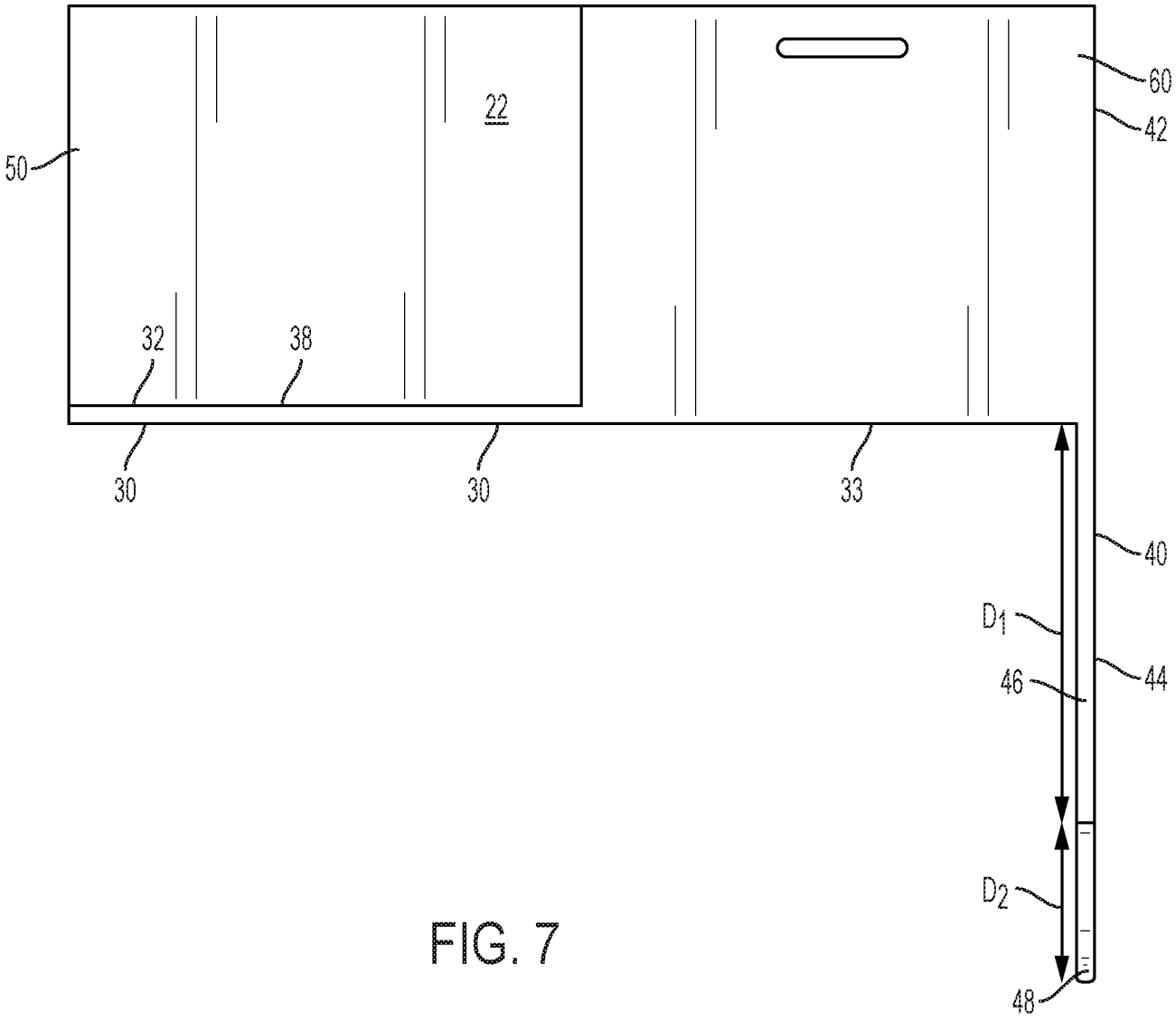
FIG. 7 is a side elevational view of one embodiment of the ladder support device of FIG. 5.
Figure 8:
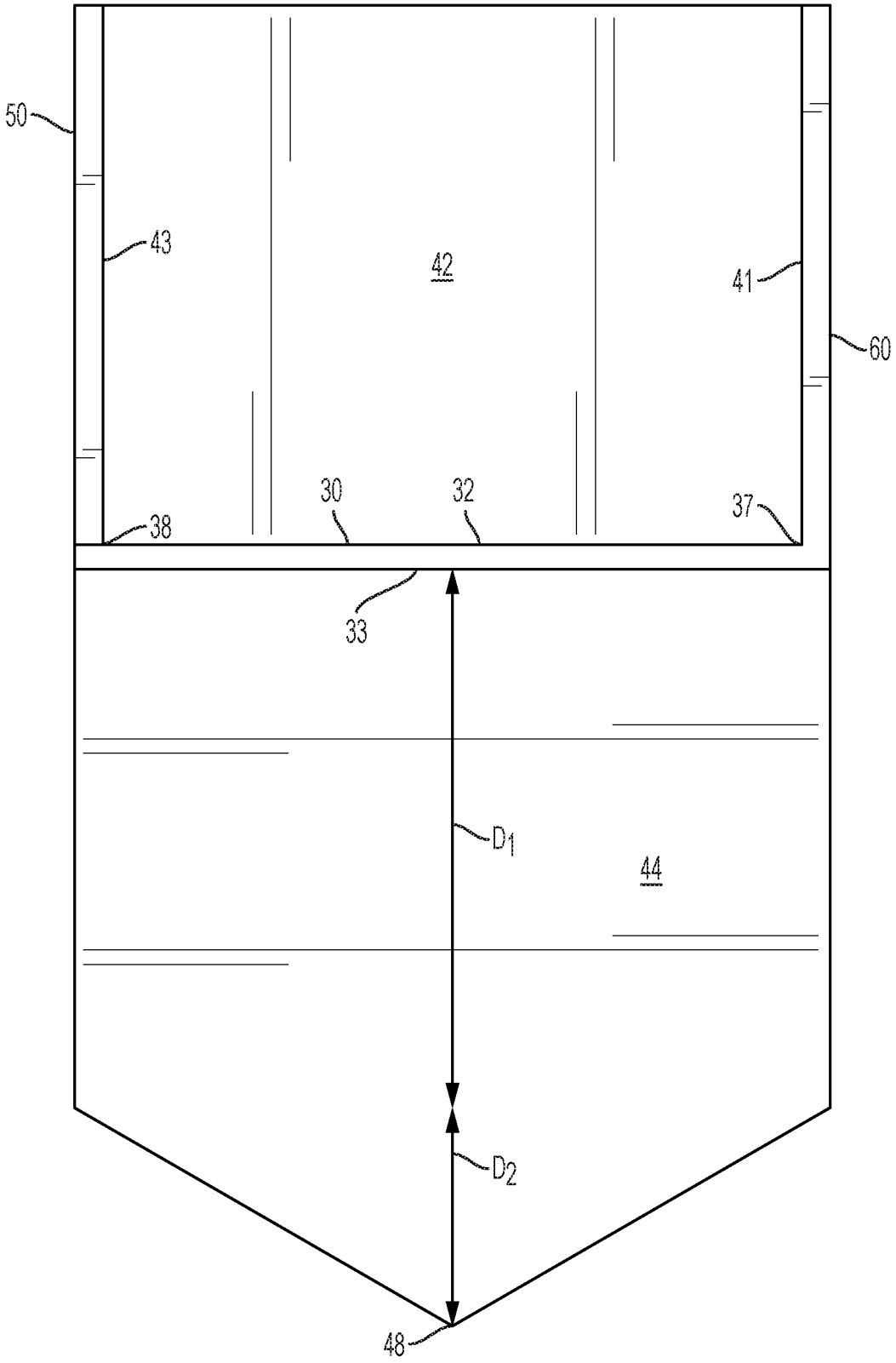
FIG. 8 is a side elevational view of one embodiment of the ladder support device of FIG. 5.

The present invention can be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

For clarity, it will be appreciated that this disclosure shows end or cross-sectional views of a ladder stabilization system. As such, it is contemplated that the described cross-section features of the elements forming the ladder stabilization system can also extend the elongate longitudinal length of the respective elements such as, for example and without limitation, the base member, the tongue member and the locking member.

As used throughout, the singular forms "a," "an" and "the" include plural referents unless the context clearly dictates otherwise. Thus, for example, reference to "an opening" can include two or more such openings unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "can," unless specifically stated otherwise, or otherwise understood within the context as used, is generally intended to convey that certain Disclosed are components that can be used to perform the disclosed methods and systems. These and other components are disclosed herein, and it is understood that when combinations, subsets, interactions, groups, etc. of these components are disclosed that while specific reference to each various individual and collective combinations and permutation of these cannot be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific embodiment or combination of embodiments of the disclosed methods.

The present methods and systems can be understood more readily by reference to the following detailed description of preferred embodiments and the examples included therein and to the Figures and their previous and following description.

Described herein is a ladder stabilization system 10 and a method of using a ladder stabilization system. In a typical installation, the ladder stabilization system 10 is selectively fixed to a ground surface in relation to a substantially vertical wall 2. It is contemplated that a conventional access ladder 4, having a pair of spaced vertical legs 6 and a plurality of spaced transversely mounted rungs 8, can be received therein the ladder stabilization system to appropriately position the ladder relative to the wall for allow for work to be conducted safely. In one example, the ladder 4 can be received within the ladder stabilization system 10 such that the ladder is appropriately positioned at a desired acute angle relative to the substantially vertical wall or a substantially vertical ladder. In one aspect, it is contemplated that the desired acute angle is between about 70 to about 80 degrees and, preferably about 75 degrees.

In one aspect, the ladder stabilization system 10 for holding a ladder 4 in place on a support surface can comprise a pair of opposed ladder stabilizer devices 20 that are configured to be operatively placed in opposition to each other (i.e., generally parallel to the vertical wall structure) to receive a bottom portion of the pair of spaced legs 6 of the ladder to positionally fix the ladder relative to the vertical structure. The ladder stabilization system 10 acts to secure and stabilize the ladder to prevent the base portion of the ladder from sliding skidding, or otherwise moving while a user is on the ladder. As shown and described, the ladder stabilization system 10 does not require any material alteration to the ladder and thus will not void the warranty of a conventional ladder when used in combination.

The ladder stabilization system 10 of the present invention helps to prevent ladders from slipping or tipping unexpectedly when a user is operating on the ladder. As shown, it is contemplated that the installation of this ladder stabilization system 10 can be selectively positioned with respect to the structure, and, as such, can allow for the selective placement of an access ladder to a specific area of a structure, taking the guess work out assuring a safe base position upon which a ladder can be confidently positioned. The ladder stabilization system 10 aids is preventing unstable ladders for both the first man up and other climbers, while insuring that the access ladder 4 can be placed at a desired acute angle. While the ladder stabilization system 10 acts as a stabilizing product to keep ladders in place, it is contemplated that the weight of a person on the access ladder 4 should be supported by placement of the respective bottoms of the legs of the access ladder 4 within the pair of opposed ladder stabilizer devices 20.

Referring to the figures, each ladder stabilizer device 20 is configured to stabilize an access ladder 4 at a desired position relative to the structure and at a desired acute angle relative to the structure. Each ladder stabilizer device 20 can comprise an elongated planer base member 30; an elongated planer stabilizer member 40; a first elongated planer side member 50; and a second elongated planer side member 60. In this aspect, the elongated planer base member 30 has a top surface 32, an opposed bottom surface 33, a base edge 35, a first side edge 37 and an opposed second side edge 38. In one aspect, the base member 30 can have a width, transverse to the elongate longitudinal length, which is at least as wide as the width of the bottom end of the ladder.

The elongated planer stabilizer member 40 is connected to the base edge 35 of the base member and has an upper portion 42 that extends upwardly away from the top surface 32 of the base member and a lower portion 44 that extends downwardly away from the bottom surface 33 of the base member. As shown, it is contemplated that the stabilizer member 40 extends perpendicular relative to the base member 30. In one optional aspect, the lower portion 44 of the stabilizer member 40 can comprise a pair of opposed side edges 46 that are parallel to each other proximate the base member 30 and, at a desired distance D1 from the bottom surface of the base member, can taper inwardly together to form a pointed distal end 48. Thus, the distal end 48 of the lower portion of the stabilizer member can have an arrow shape, or other geometric shape, such as, and without limitation, a blade suitable for insertion into soil. The lower portion 44 of the stabilizer member 40 can have a surface area of between about 4.5 $in^2$ to about 7.5 $in^2$, preferably between about 5.0 $in^2$ to about 7.0 $in^2$, and more preferred between about 5.5 $in^2$ to about 6.5 $in^2$. The planar form and the increased amount of surface area of the stabilizer member 40 advantageously allows for increased confidence by the user in the fixation qualities of the ladder stabilizer device 20 upon the insertion of the lower portion of the stabilizer member 40 into a soil surface.

In one aspect, it is contemplated that the longitudinal length of the lower portion 44 of the stabilizer member 40 can be greater than the longitudinal length of the upper portion 42 of the stabilizer member. In a further aspect, it is contemplated the distal end 48 of the lower portion of the stabilizer member extends a second distance D2 from the desired distance D1 defined by the pair of opposed side edges 46. In this aspect, the second distance D2 is less than the desired distance D1 such that the top portion of the lower portion of the stabilizer member (defined by the desired distance) has a greater surface area than the bottom portion of the lower portion of the stabilizer member (defined by the arrow shaped distal end). Further, it is contemplated that the desired distance D1 can have a length that allows for operative contact of at least a portion of a side edge 46 with a portion of a floor joist that underlies the deck boards when the stabilizer device 20 is selectively mounted onto a deck.

In a further aspect, the first elongated planer side member 50 extends upwardly away from the top surface 32 of the base member. In this aspect, the first side member 50 extends perpendicular relative to the base member 30 and is connected to the first side edge 37 of the base member and a first edge 41 of the upper portion 42 of the stabilizer member. Similarly, the second elongated planer side member 60 extends upwardly away from and perpendicular relative to the top surface 32 of the base member. The second side member 60 is connected to a portion of the second side edge 38 of the base member and a second edge 43 of the upper portion 42 of the stabilizer member. As shown in the figures, the second side member 60 has an elongate length that is less than the elongate length of the first side member 50 and the elongate length of the base member 30. In this aspect, it is contemplated that the elongate length of the first side member 50 equals the elongate length of the base member 30. As shown, the base member, the upper portion of the stabilizer member, the first side member, and the second side member of each ladder stabilizer device defines a partially open trough 22 that is configured to receive a bottom end of one leg of the ladder.

In one aspect, it is contemplated that the elongate length of the first side member 50 and the elongate length of the base member 30 can extend beyond the elongate length of the second side member 60 by at least the width of the bottom end of the leg 6 of the ladder 4 so that the bottom end can be received within the partially open trough and onto at least a portion of the top surface of the base member. Optionally, it is contemplated that the ratio of the longitudinal length of the base member 30 and the first side member 50 to the longitudinal length of the second side member 60 is about 2:1.

In one aspect, the heights, relative to the top surface of the base member 30, of the upper portion 42 of the stabilizer member 40, the first side member 50, and the second side member 60 can be substantially equal. Optionally, the height of at least one of the base member 30, of the upper portion 42 of the stabilizer member, the first side member 50, and the second side member 60 can differ. In one particular aspect, the heights, relative to the top surface of the base member 30, of the upper portion of the stabilizer member 40, the first side member 50, and the second side member 60 are greater than 1.5 inches.

When operatively positioned there on the support surfaces the base member 30, select portions of the respective partially open troughs 22 of the pair of opposed ladder stabilizer devices 20 are positioned in opposition and are configured to selectively receive the bottom ends of the legs 6 of the ladder 4. In one non-limiting example, the pair of opposed ladder stabilizer devices 20 can be positioned such that the planes of the elongated planer stabilizer members 40 are substantially parallel to the vertical structure of interest and the second side members 60 of the pair of opposed ladder stabilizer devices 20 are positioned parallel to each other in opposition. This would be the typical orientation for a ground soil application. In a further example, in a deck surface application in which the adjacent parallel oriented deck boards are positioned parallel relative to the substantially vertical structure, the second side members 60 of the pair of opposed ladder stabilizer devices 20 are positioned parallel to each other in opposition. In these exemplary aspects, it is contemplated that the bottom ends of the legs 6 of the ladder 4 will be positioned in contact with at least a portion of the top surface 32 of the base member and at least a portion of one or more of the stabilizer member 40; the first side member 50; and the second side member 60, which defines the partially open troughs 22.

Optionally, in a deck surface application in which the adjacent parallel oriented deck boards are positioned perpendicular relative to the substantially vertical structure, the pair of opposed ladder stabilizer devices 20 can be positioned such that the upper portions of the stabilizer members 40 of the pair of opposed ladder stabilizer devices 20 are positioned parallel to each other in opposition, i.e., the planes of the stabilizer members 40 are substantially parallel to each other in opposition. In this aspect, it is contemplated that the bottom ends of the legs of the ladder will be positioned in contact with at least a portion of the top surface 32 of the base member and at least a portion of the first side member 50 and, optionally, with a portion of the edge the second side member 60, which defines a portion of the partially open troughs 22. More particularly, in this exemplary application, the bottom end of one leg 6 of the ladder 4 can contact a portion of the base member 30 proximate a distal end of the first side member 50 and at least a portion of the distal end of the first side member 50 upon receipt into the partially open trough.

Thus, depending on the relative orientation of the pair of opposed ladder stabilizer devices relative to the vertical structure, the bottom ends of the legs of the ladder will be positioned in contact with at least a portion of the top surface 32 of the base member and to at least a portion of one or more of the stabilizer member 40; the first side member 50; and the second side member 60, which defines the partially open troughs 22.

In one aspect, the lower portion of the stabilizer member has a thickness that is configured to be accepted therein a gap defined by adjacent parallel oriented deck boards. In one aspect the thickness of the lower portion of the stabilizer member can be between about 0.10 to about 0.25 inches; preferably between about 0.110 to about 0.130 inches, and more preferred less than about 0.125 inches.

The elongated planer base member 30; the elongated planer stabilizer member 40; the first elongated planer side member 50; and the second elongated planer side member 60 can be made from any material possessing the necessary strength to support the access ladder 4, the concomitant load thereon when the access ladder 4 is in use, and the load imparted by insertion into a soil ground support, such as, for example and without limitation, galvanized steel, aluminum or metal tubing or solid stock, plastic, reinforced fiberglass, carbon fiber, and the like. One of ordinary skill in the art will recognize that this list is representative of materials that may be used, and is not exhaustive. In optional aspects, it is contemplated that each ladder stabilizer device 20 can be formed as a unitary, monolithic member, such that the base member 30; the stabilizer member 40; the first side member 50; and the second side member 60 are integral to each other.

In one aspect, the base member 30 can further comprise means to increase the traction level for the leg of the ladder that is positioned on the top surface 32 of the base member. The means to increase the traction level can comprise, for example and without limitation, frictional tape that can be secured to the top surface and that has a desired level of embedded grit to provide a desired level of anti-slip traction; texture, such as elevated patterns formed in the upper surface of the spacing member, and the like.

In one aspect, the base member 30 can be configured to selectively fixedly mount to the underlying support surface and to aid in stabilizing position of the respective relative to the vertical structure. The base member 30 can defines at least one opening 37 that are configured to receive at least one fastener (not shown), such as, for example and without limitation, screws, bolts, nails, and the like, which are configured to securely mount the base member 30 to a deck board. In one aspect, the at least one opening 37 can be spaced from the upper portion of the stabilizer member and can be defined in a distal portion of the base member. Optionally, at least one of the openings 37 can be spaced from the stabilizer member 40 at a distance consistent with the width of a conventional deck board so that a securing member could be inserted into the gap defined by adjacent parallel oriented deck boards and otherwise selectively fixed to at least a portion of the opposing edges of the adjoining deck boards that define the gap.

It is further contemplated that the at least one opening 37 can comprise a plurality of openings. In this aspect, the respective openings of the plurality of openings can be spaced from the upper portion of the stabilizer member at staggered longitudinal distances. Optionally, the plurality of openings can be positioned in an array of staggered openings that are spaced along a line that is angled with respect to the longitudinal axis of the base member. In operation, the stabilizer member can be positioned such that at least one opening overlies the gap defined by adjacent parallel oriented deck boards and the fastener can be inserted through the overlying opening to be selectively fixed to at least a portion of the opposing edges of the adjoining deck boards that define the gap.

It is further contemplated that the at least one opening 37 can comprise at least one elongated slot that extends parallel to the longitudinal axis of the base member. Optionally, the at least one slot can comprise a plurality of slots. In this aspect, the respective slots of the plurality of slots can be spaced from the upper portion of the stabilizer member at staggered longitudinal distances. Optionally, the plurality of openings can be positioned in an array of staggered slots that are spaced about a line that is angled with respect to the longitudinal axis of the base member. In operation, the stabilizer member can be positioned such that a portion of at least one slot overlies the gap defined by adjacent parallel oriented deck boards and the fastener can be inserted through the overlying slot and into the gap to be selectively fixed to at least a portion of the opposing edges of the adjoining deck boards that define the gap.

In one optional aspect, the fastener can be a conventional anchor system, such as, for example and without limitation, split screws, blade screws, deformable elongated anchor member that expands upon the insertion of a drive screw, such as manufactured by HILTI, HPS-1 (plastic impact anchor with drive screw), HMH (nail-in anchor with nail). As contemplated, the conventional anchor system allows for the insertion of a portion of the anchor system through the opening or the slot and into the gap for subsequent selective fixation to the portion of the opposing edges of the adjoining deck boards that define the gap.

In a further aspect, the ladder stabilization system 10 can further comprise a pair of anchor lines 80. In this aspect, each anchor line can be flexible and can be conventionally coupled to form a continuous loop having a selectable peripheral length. In this aspect, it is contemplated that each anchor line can be connected to a portion of the respective ladder support device and is configured to selectively couple to a bottom portion of the ladder to selectively secure the relative position between the bottom ends of the inclined ladder and the respective ladder support device. In one aspect, each anchor line can be connected to a portion of the distal end of the first support member of the respective ladder support device. Optionally, each anchor line 80 can be connected to the upper portion 42 of the stabilizer member 40 of the respective ladder support device. Optionally, each anchor line can comprises means for cinching the bottom ends of the ladder into desired secure contact with portions of the respective ladder support devices, such cinching means an comprise conventional buckles/loop systems, clasp systems, hook/loop systems, and the like.

It should be emphasized that the above-described aspects are merely possible examples of implementations, merely set forth for a clear understanding of the principles of the present disclosure. Many variations and modifications can be made to the above-described embodiment(s) without departing substantially from the spirit and principles of the present disclosure. All such modifications and variations are intended to be included herein within the scope of the present disclosure, and all possible claims to individual aspects or combinations of elements or steps are intended to be supported by the present disclosure. Moreover, although specific terms are employed herein, as well as in the claims which follow, they are used only in a generic and descriptive sense, and not for the purposes of limiting the described invention, nor the claims which follow.

What is claimed is:

1. A ladder stabilization system for selectively receiving a ladder having a pair of spaced legs and a plurality of spaced transversely mounted rungs that contacts to a substantially vertical structure at an acute angle, comprising:

a pair of opposed ladder stabilizer devices, each ladder stabilizer device comprising:

an elongated planar base member having a top surface, an opposed bottom surface, a base edge, a first side edge and an opposed second side edge;

an elongated planar stabilizer member connected to the base edge of the base member and having an upper portion extending upwardly away from the top surface and a lower portion extending downwardly away from the bottom surface of the base member, wherein the stabilizer member extends perpendicular relative to the base member;

a first elongated planar side member extending upwardly away from the top surface of the base member, wherein the first side member extends perpendicular relative to the base member and is connected to the first side edge of the base member and a first edge of the upper portion of the stabilizer member; and a second elongated planar side member extending upwardly away from the top surface of the base member, wherein the second side member extends perpendicular relative to the base member and is connected to a portion of the second side edge of the base member and a second edge of the upper portion of the stabilizer member, wherein the second side member has an elongate length that is less than an elongate length of the first side member and an elongate length of the base member, wherein the base member, the upper portion of the stabilizer member, the first side member, and the second side member of each ladder stabilizer device defines a partially open trough that is configured to receive a bottom end of one respective leg of the pair of spaced legs of the ladder, wherein said trough is configured to receive said bottom end of the one respective leg when said bottom end is slid sideways in a horizontal direction parallel to said planar base member into said trough, and wherein portions of the respective partially open trough members of the pair of opposed ladder stabilizer devices are positioned in opposition to each other; and where in a longitudinal length of the lower portion of the stabilizer member is greater than a longitudinal length of the upper portion of the stabilizer member.

2. The ladder stabilization system of claim 1, wherein heights, relative to the top surface of the base member, of the respective upper portion of the stabilizer member, the first side member, and the second side member are substantially equal.

3. The ladder stabilization system of claim 2, wherein the heights, relative to the top surface of the base member, of the respective upper portion of the stabilizer member, the first side member, and the second side member are greater than 1.5 inches.

4. The ladder stabilization system of claim 1, wherein a distal end of the lower portion of the stabilizer member has an arrow shape.

5. The ladder stabilization system of claim 1, wherein the lower portion of the stabilizer member has a thickness that is configured to be accepted therein a gap defined by adjacent parallel oriented deck boards.

6. The ladder stabilization system of claim 5, wherein the thickness of the lower portion of the stabilizer member is between about 0.10 to about 0.25 inches.

7. The ladder stabilization system of claim 5, wherein the thickness of the lower portion of the stabilizer member is between about 0.110 to about 0.130 inches.

8. The ladder stabilization system of claim 5, wherein the adjacent parallel oriented deck boards are positioned parallel relative to the substantially vertical structure, and wherein the second side members of the pair of opposed ladder stabilizer devices are positioned parallel to each other in opposition to each other.

9. The ladder stabilization system of claim 8, wherein the bottom end of one leg of the ladder contacts a portion of the base member and at least a portion of the upper portion of the stabilizer member upon receipt into the partially open trough.

10. The ladder stabilization system of claim 5, wherein the adjacent parallel oriented deck boards are positioned perpendicular relative to the substantially vertical structure, and wherein the upper portions of the stabilizer members of the pair of opposed ladder stabilizer devices are positioned parallel to each other in opposition to each other.

11. The ladder stabilization system of claim 10, wherein the bottom end of one leg of the ladder contacts a portion of the base member proximate a distal end of the first side member and at least a portion of the first side member upon receipt into the partially open trough.

12. The ladder stabilization system of claim 11, wherein the bottom end of one leg of the ladder contacts at least a portion of a distal edge of the second side member upon receipt into the partially open trough.

13. The ladder stabilization system of claim 1, wherein the base member defines at least one opening that is configured to operatively receive a fastener, which is configured to selectively mount the base member to an underlying deck board.

14. The ladder stabilization system of claim 13, wherein the at least one opening is spaced from the stabilizer member and is defined in a distal portion of the base member.

15. The ladder stabilization system of claim 1, wherein the base member has a width that is at least as wide as a width of the bottom end of the ladder.

16. The ladder stabilization system of claim 15, wherein the elongate length of the base member and the first side member exceeds the elongate length of the second side member by at least the width of the bottom end of the ladder.

17. The ladder stabilization system of claim 15, wherein the ratio of the elongate length of the base member and the first side member to the elongate length of the second side member is about 2:1.

18. The ladder stabilization system of claim 1, further comprising a pair of anchor lines, each anchor line being connected to a portion of the respective ladder stabilizer device and being configured to selectively couple to a bottom portion of the ladder to selectively secure the relative position between the bottom ends of the inclined ladder and the respective ladder stabilizer device.

19. The ladder stabilization system of claim 18, wherein each anchor line comprises means for cinching the bottom ends of the ladder into desired secure contact with portions of the respective ladder stabilizer devices.

20. A ladder stabilization system for selectively receiving a ladder having a pair of spaced legs and a plurality of spaced transversely mounted rungs that contacts to a substantially vertical structure at an acute angle, comprising:

a pair of opposed ladder stabilizer devices, each ladder stabilizer device comprising:

an elongated planar base member having a top surface, an opposed bottom surface, a base edge, a first side edge and an opposed second side edge;

an elongated planar stabilizer member connected to the base edge of the base member and having an upper portion extending upwardly away from the top surface and a lower portion extending downwardly away from the bottom surface of the base member, wherein the stabilizer member extends perpendicular relative to the base member;

a first elongated planar side member extending upwardly away from the top surface of the base member, wherein the first side member extends perpendicular relative to the base member and is connected to the first side edge of the base member and a first edge of the upper portion of the stabilizer member; and a second elongated planar side member extending upwardly away from the top surface of the base member, wherein the second side member extends perpendicular relative to the base member and is connected to a portion of the second side edge of the base member and a second edge of the upper portion of the stabilizer member, wherein the second side member has an elongate length that is less than the elongate length of the first side member and the elongate length of the base member; and a pair of anchor lines, each anchor line being connected to a portion of the respective ladder support device and being configured to selectively couple to a bottom portion of the ladder to selectively secure the relative position between the bottom ends of the inclined ladder and the respective ladder support device, wherein the ratio of the longitudinal length of the base member and the first side member to the longitudinal length of the second side member is about 2:1, and wherein the base member, the upper portion of the stabilizer member, the first side member, and the second side member of each ladder stabilizer device defines a partially open trough that is configured to receive a bottom end of one respective leg of the pair of spaced legs of the ladder, wherein said trough is configured to receive said bottom end of the one respective leg when said bottom end is slid sideways in a horizontal direction parallel to said planar base member into said trough, and wherein portions of the respective partially open trough members of the pair of opposed ladder stabilizer devices are positioned in opposition to each other; and where in a longitudinal length of the lower portion of the stabilizer member is greater than a longitudinal length of the upper portion of the stabilizer member.

21. The ladder stabilization system of claim 20, wherein portions of the respective partially open trough members of the pair of opposed ladder stabilizer devices are positioned in opposition to each other.

* * * * *